US011325172B2

(12) United States Patent
Taylor et al.

(10) Patent No.: US 11,325,172 B2
(45) Date of Patent: May 10, 2022

(54) AUTO GAUGE SYSTEM AND METHOD FOR ROLL FORMING MACHINE

(71) Applicant: TEKFAB, Inc., Albany, OR (US)

(72) Inventors: Robert Brooks Taylor, Jefferson, OR (US); Aaron David Roth, Scio, OR (US)

(73) Assignee: TEFAB, INC., Albany, OR (US)

( * ) Notice: Subject to any disclaimer, the term of this patent is extended or adjusted under 35 U.S.C. 154(b) by 0 days.

(21) Appl. No.: 16/541,034

(22) Filed: Aug. 14, 2019

(65) Prior Publication Data

US 2021/0205867 A1 Jul. 8, 2021

Related U.S. Application Data

(60) Provisional application No. 62/718,843, filed on Aug. 14, 2018.

(51) Int. Cl.
*B21D 5/08* (2006.01)
*B21B 37/18* (2006.01)

(52) U.S. Cl.
CPC ..... *B21B 37/18* (2013.01)

(58) Field of Classification Search
CPC ..... B21D 5/08; B21D 5/083; B21B 31/16; B21B 31/20; B21B 31/22; B21B 31/26; B21B 37/18
See application file for complete search history.

(56) References Cited

U.S. PATENT DOCUMENTS 4,009,610 A * 3/1977 Hien ..... B21B 17/06 72/209
5,829,294 A * 11/1998 Bradbury ..... B21B 31/08 72/176
6,109,083 A * 8/2000 Steinmair ..... B21D 5/086 72/181
6,148,654 A * 11/2000 Jensen ..... B21D 5/08 72/178
6,647,754 B2 * 11/2003 Bodnar ..... B21D 5/08 72/181
8,783,081 B2 * 7/2014 Voth ..... B21D 5/08 72/181

* cited by examiner

*Primary Examiner* — Edward T Tolan
(74) *Attorney, Agent, or Firm* — Procopio Cory Hargreaves and Savitch LLP

(57) ABSTRACT

An automatically adjusting auto gauge system comprises a servo motor that provides rotational motion; at least one of a gearbox and linear actuator driven by the one or more servo motors to transfer the rotational motor of the servo motor to linear motion; a group of roll former passes, each including a cam arm, an eccentric cam, a push rod, a top set of roll tooling, a bottom set of roll tooling; a bar operably coupled to the gearbox and the cam arms of the group of roll former passes, the bar driven by the gearbox to impart linear motion to the cam arms, which in turn imparts rotational motion to each eccentric cam, which in turn imparts linear motion, raising or lowering the top set of roll tooling via the push rod, adjusting a gap between the top and bottom sets of roll tooling.

9 Claims, 6 Drawing Sheets

AUTO GAUGE SYSTEM AND METHOD FOR ROLL FORMING MACHINE

CROSS-REFERENCE TO RELATED APPLICATION

This application claims priority to U.S. provisional patent application No. 62/718,843, filed Aug. 14, 2018 under 35 U.S.C. 119, which is incorporated by reference herein.

FIELD OF THE INVENTION

The present invention relates to auto gauge systems and methods for roll forming machines.

SUMMARY OF THE INVENTION

An aspect of the invention involves an auto gauge system that automatically adjusts all (or most) passes for different gauges (thickness) of steel. The gauge information comes from a computer-controlled system, which causes servo motors to be positioned. The servo motors drive a gearbox/linear actuator that transfers its rotational motion to linear motion. The rollformer can be broken up into as many "groups" as required for individual positional adjustments. A group here is defined as a section of the rollformer where there is one servo and one bar controlling a group of passes. This linear motion pushes/pulls a cam arm, which rotates an eccentric cam. The eccentric cam raises and lowers a top set of roll tooling, making the gap between the top and bottom sets of roll tooling larger or smaller. Certain passes require manual adjustment to achieve the desired product profile. Where this is required, a mixer allows manual adjustment to be added to, or subtracted from the automatic adjustment. In case the wrong thickness steel is loaded into the rollformer and an overload situation is created, an overload assembly, which includes a spring-pack, compresses to allow the material to pass-through the machine without damage.

Another aspect of the invention involves an auto gauge system that automatically adjusts passes for different gauges of steel comprising a servo motor that provides rotational motion; a gearbox/linear actuator driven by the one or more servo motors to transfer the rotational motor of the servo motor to linear motion; a roll pass assembly including a group of roll former passes, each roll former pass including a cam arm, an eccentric cam, a push rod, a top set of roll tooling, a bottom set of roll tooling; a bar operably coupled to the gearbox and the cam arms of the group of roll former passes, the bar driven by the gearbox/linear actuator to impart linear motion to the cam arms, which in turn imparts rotational motion to each eccentric cam, which in turn imparts linear motion, raising or lowering the top set of roll tooling via the push rod, adjusting a gap between the top and bottom sets of roll tooling larger or smaller, adjusting passes for different gauges of steel.

One or more implementations of the aspect of the invention described immediately above includes one or of the following: a matching roll pass assembly adjacent to the roll pass assembly and a cam connection shaft operably coupling respective eccentric cams of the roll pass assembly and the matching roll pass assembly to cause a same automatic adjustment of passes in the matching roll pass assembly and the roll pass assembly; an overload assembly that accommodates an overload of pressure forces on the top set of roll tooling and the bottom set of roll tooling; an overload spring that compresses to accommodate the overload of pressure forces on the top set of roll tooling and the bottom set of roll tooling; a manually adjusted pass assembly that allows manual adjustment to be added to or subtracted from automatic adjustment; the manually adjusted pass assembly includes a secondary linear adjustment device, a secondary slide gibbs, and a secondary slide block that may be pushed or pulled in secondary slide gibbs by the secondary linear adjustment device; the manually adjusted pass assembly includes a secondary pivot point, secondary lever arms, and the pushing or pulling of the secondary slide block in secondary slide gibbs by the secondary linear adjustment device changes a position of the secondary pivot point, allowing a secondary positive or negative position offset to be added to the secondary lever arms, which allows manual adjustment to be added to or subtracted from automatic adjustment.

An additional aspect of the invention involves an auto gauge system that automatically adjusts passes for different gauges of steel comprising a roll pass assembly including a group of roll former passes, each roll pass assembly including a top set of roll tooling, a bottom set of roll tooling, a gap between the top set of roll tooling and the bottom set of roll tooling, and a roll tooling gap adjustment mechanism that imparts movement to at least one of the top set of roll tooling and the bottom set of roll tooling to adjust the gap between the top and bottom sets of roll tooling larger or smaller, adjusting passes for different gauges of steel; a roll pass assembly mechanism operably coupled to the roll tooling gap adjustment mechanism of each roll former pass of the roll pass assembly to impart movement thereto to adjust the gap between the top and bottom sets of roll tooling larger or smaller, adjusting passes for different gauges of steel.

One or more implementations of the aspect of the invention described immediately above includes one or of the following: a servo motor that provides rotational motion; a gearbox/linear actuator driven by the one or more servo motors to transfer the rotational motor of the servo motor to linear motion; each roll former pass including a cam arm, an eccentric cam, a push rod; a bar operably coupled to the gearbox/linear actuator and the cam arms of the group of roll former passes, the bar driven by the gearbox to impart linear motion to the cam arms, which in turn imparts rotational motion to each eccentric cam, which in turn imparts linear motion, raising or lowering the top set of roll tooling via the push rod, adjusting a gap between the top and bottom sets of roll tooling larger or smaller, adjusting passes for different gauges of steel; a matching roll pass assembly adjacent to the roll pass assembly and a coupling mechanism that operably couples the roll tooling gap adjustment mechanisms of the roll pass assembly and the matching roll pass assembly to cause a same automatic adjustment of passes in the matching roll pass assembly and the roll pass assembly; an overload assembly that accommodates an overload of pressure forces on the top set of roll tooling and the bottom set of roll tooling; a manually adjusted pass assembly that allows manual adjustment to be added to or subtracted from automatic adjustment.

A further aspect of the invention involves a method of automatically adjusting passes for different gauges of steel using the auto gauge system. The method comprises imparting movement to the roll tooling gap adjustment mechanisms with the roll pass assembly mechanism; imparting movement to at least one of the top set of roll tooling and the bottom set of roll tooling with the roll tooling gap adjustment mechanisms to adjust the gap between the top and bottom sets of roll tooling larger or smaller, adjusting passes for different gauges of steel.

One or more implementations of the aspect of the invention described immediately above includes one or of the following: a servo motor that provides rotational motion; a gearbox/linear actuator driven by the one or more servo motors to transfer the rotational motion of the servo motor to linear motion; each roll former pass including a cam arm, an eccentric cam, a push rod; a bar operably coupled to the gearbox and the cam arms of the group of roll former passes, the bar driven by the gearbox/linear actuator to impart linear motion to the cam arms, which in turn imparts rotational motion to each eccentric cam, which in turn imparts linear motion, raising or lowering the top set of roll tooling via the push rod, adjusting a gap between the top and bottom sets of roll tooling larger or smaller, adjusting passes for different gauges of steel; a matching roll pass assembly adjacent to the roll pass assembly and a coupling mechanism that operably couples the roll tooling gap adjustment mechanisms of the roll pass assembly and the matching roll pass assembly to cause a same automatic adjustment of passes in the matching roll pass assembly and the roll pass assembly; an overload assembly that accommodates an overload of pressure forces on the top set of roll tooling and the bottom set of roll tooling; a manually adjusted pass assembly that allows manual adjustment to be added to or subtracted from automatic adjustment.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1:
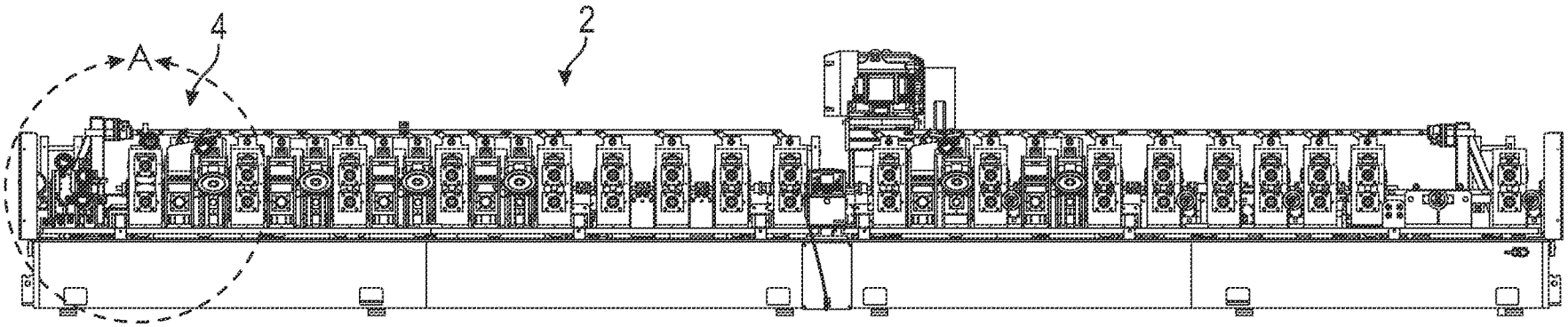
FIG. 1 is a front elevational view of an embodiment of a roll forming machine and an auto gauge system for the roll forming machine.
Figure 2:
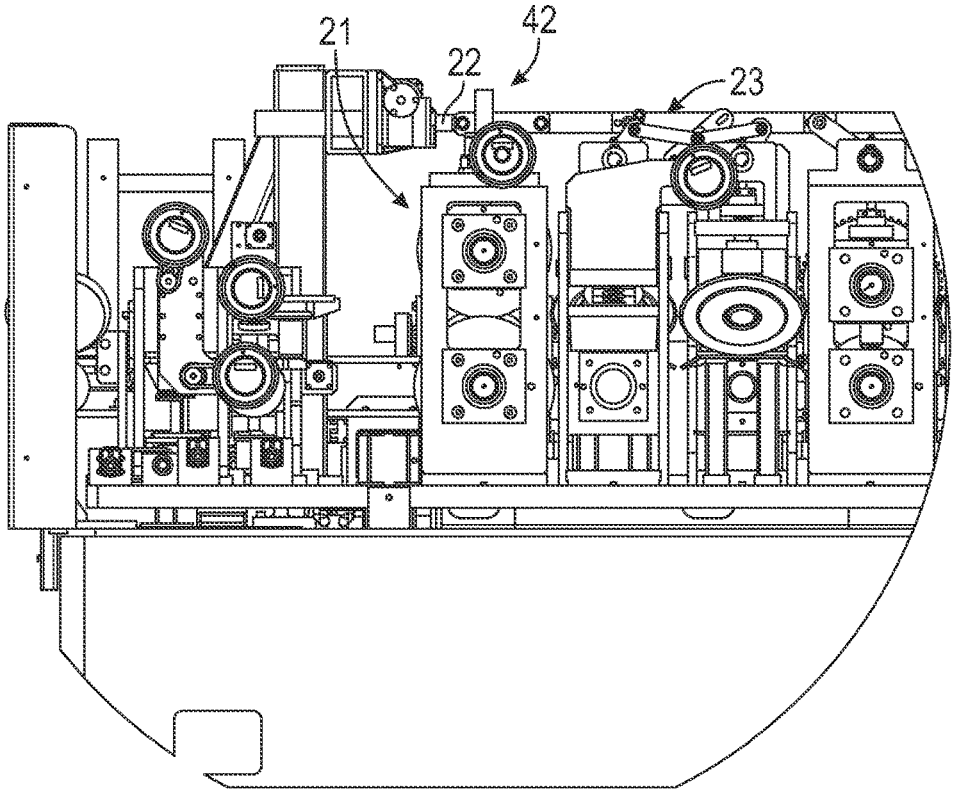
FIG. 2 is an enlarged front elevational view of the roll forming machine and the auto gauge system shown at section A in FIG. 1.
Figure 3:
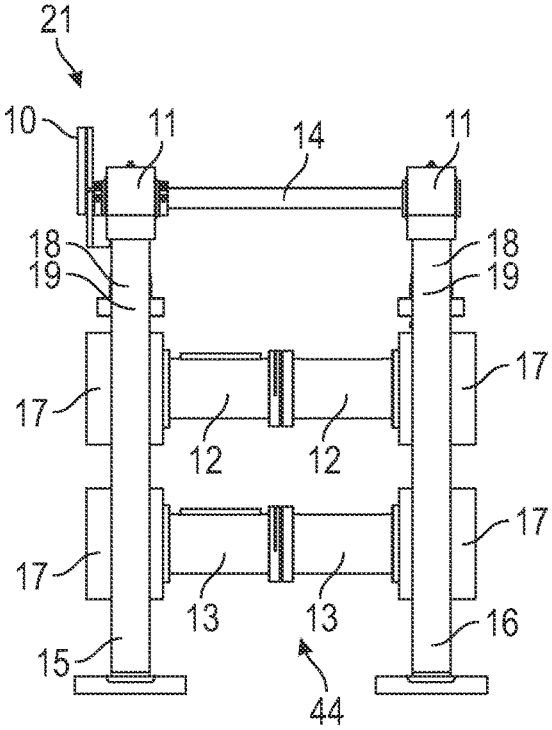
FIG. 3 is a side elevational view of an embodiment of a roll pass assembly of the roll forming machine and the auto gauge system shown in FIGS. 1 and 2.
Figure 4A:
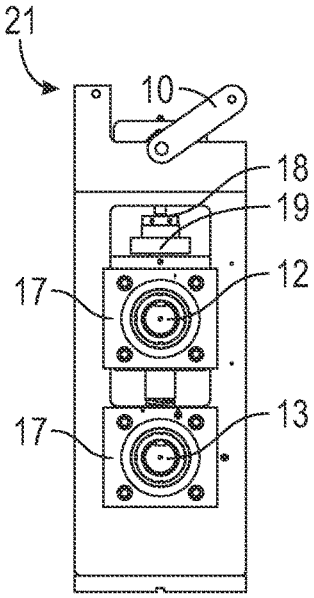
FIG. 4A is a front elevational view of the roll pass assembly shown in FIG. 3.
Figure 4B:
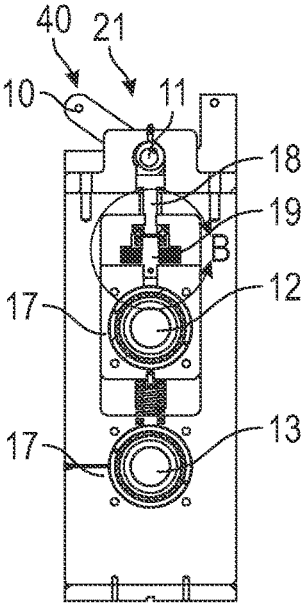
FIG. 4B is a rear elevational view of the roll pass assembly shown in FIG. 3.
Figure 5:
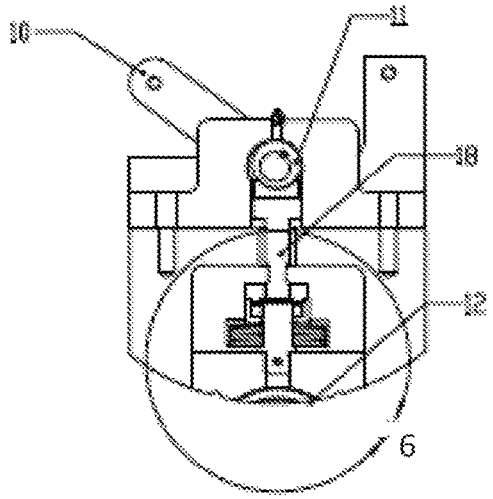
FIG. 5 is a front elevational view of an upper part of the roll pass assembly shown in FIGS. 3-4B.
Figure 6:
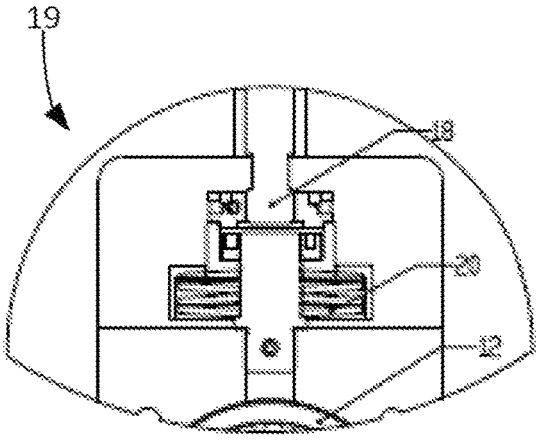
FIG. 6 is an enlarged front elevational view of the detail area 6 of the upper part of the roll pass assembly shown in FIG. 5.

With reference to FIGS. 1-9, an embodiment of an auto gauge system 2 and method for a roll forming machine or rollformer 4 will be described.

In the auto gauge system 2 and method, the process of adjusting the roll forming machine 4 for different thickness materials is by adjusting the spacing of top and bottom roll tooling shafts 12, 13. The roll tooling shafts 12, 13 rotate in bearing assemblies 17. The top and bottom roll tooling shafts 12, 13 are mounted together in the roll pass assembly 21 shown in FIG. 3. Multiple roll pass assemblies 21 are used in the rollformer 4 to roll the material into the desired shape.

The present invention relates to adjusting at least one of the top and bottom roll tooling shafts 12, 13, and preferably adjusting only the top roll tool shafts 12 using ganged lever arms 10 and eccentric cams 11. A linear motion mechanism/actuator 22 imparts linear motion to a connecting bar 23, which gangs a group of roll pass assemblies 21 together so that the same linear motion is transferred to multiple roll pass assemblies or passes 21 (e.g., cam arms are connected by the bar 23, which is actuated using servo and work drive linear actuator 22 to allow for all rollstands to be adjusted simultaneously the same amount). The linear motion mechanism 22 and the connecting bar 23 form a roll pass assembly mechanism 42.

The linear motion is transferred to a rotational motion via the lever arm 10. The lever arm 10 pivots around an eccentric cam 11. The eccentric cam 11 rotates and due to its eccentric nature applies pressure to gauge adjustment push rod 18. The lever arm 10, eccentric cam 11, and the gauge adjustment push rod 18 form a roll tooling gap adjustment mechanism 40. The gauge adjustment push rod 18 then raises or lowers the top roll tooling shaft 12. The bottom roll tooling shaft 13 is stationary. This action moves the top and bottom rolls apart to the desired distance. A coupling mechanism 44 in the form of a cam connection shaft 14 causes the exact same action to happen on matching frontside roll pass assembly 25.

This invention includes an overload assembly 19. In the case where the rollformer 4 has been adjusted incorrectly, or the wrong (e.g., thicker) material has been fed into the rollformer 4, the overload of pressure forces the gauge adjustment push rod 18 up, compressing overload spring 20. The overload spring 20 preload is set at manufacture for the material being run. Under normal operation, the overload assembly does not function as part of the auto-gauge system and only functions (deflects) in an overload condition.

Figure 7A:
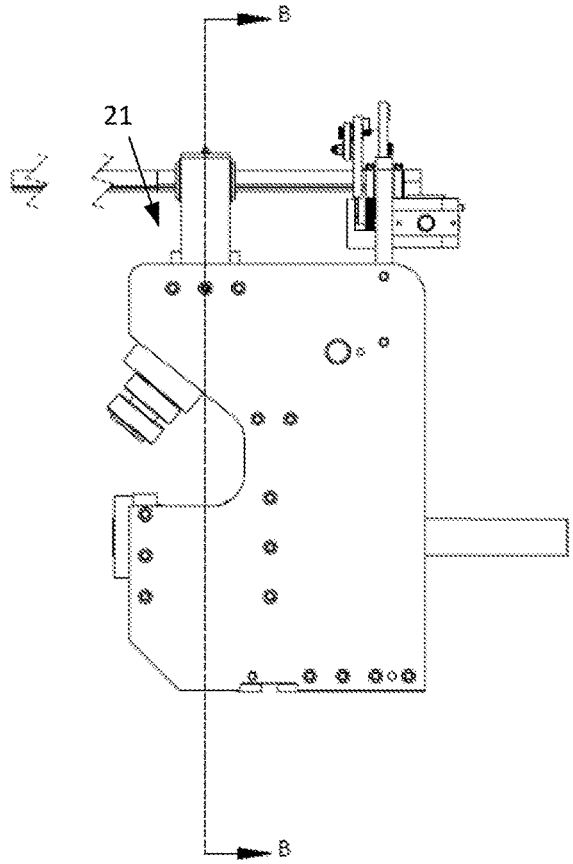
FIG. 7A is a side-elevational view of an embodiment of a manually adjusted pass assembly.
Figure 7B:
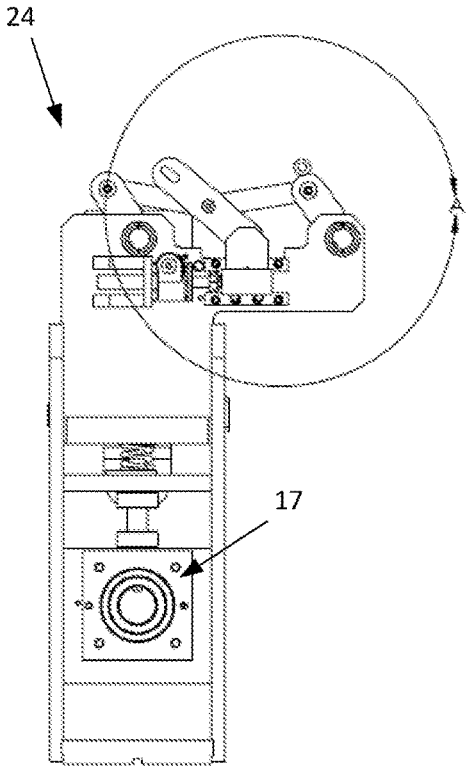
FIG. 7B is a front elevational view of the manually adjusted pass assembly of FIG. 7A.
Figure 7C:
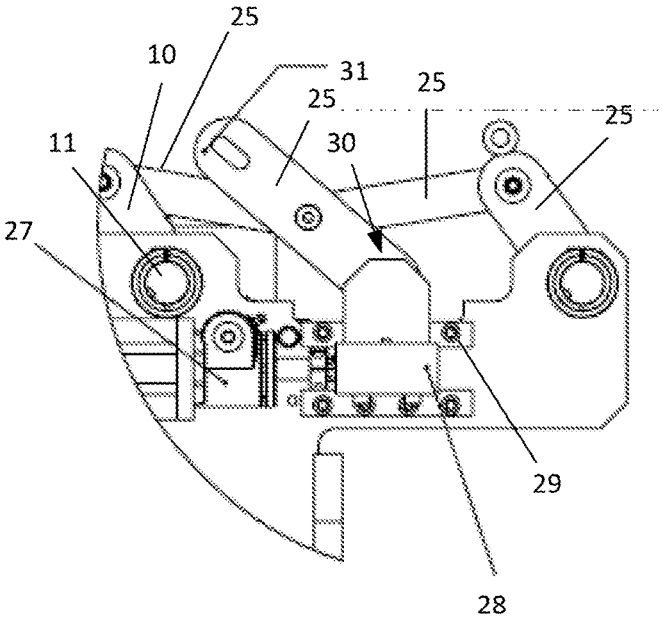
FIG. 7C is an enlarged front elevational view of the detail area A of an upper part of the manually adjusted pass assembly shown in FIG. 7B.
Figure 8A:
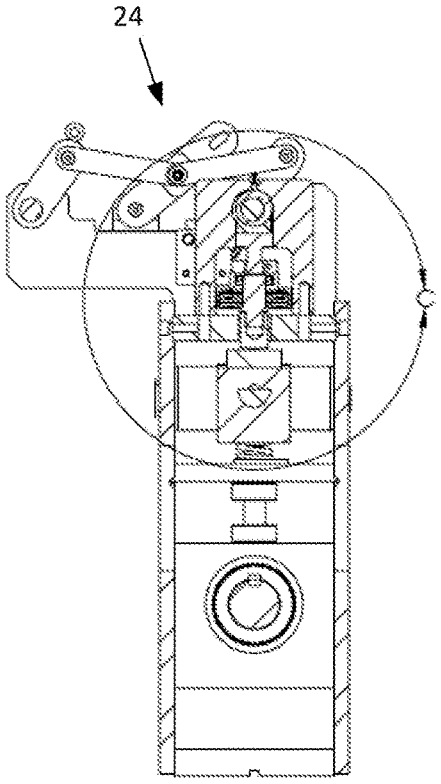
FIG. 8A is a cross-sectional view of the manually adjusted pass assembly taken along B-B of FIG. 7A.
Figure 8B:
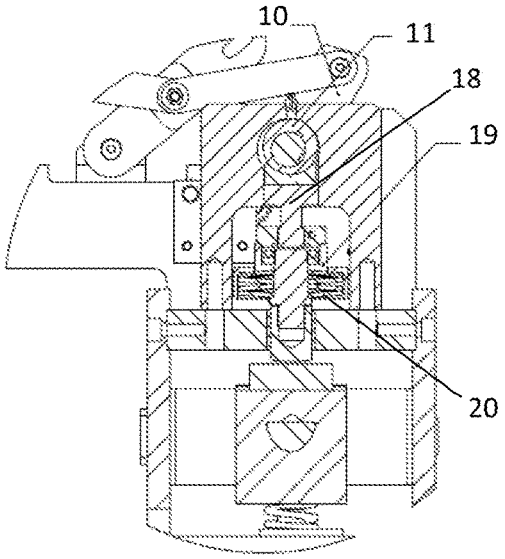
FIG. 8B is an enlarged front elevational view of the detail area C of the upper part of the manually adjusted pass assembly shown in FIG. 8A.

With reference to FIGS. 7A-7C, there are defined passes on the rollformer 4 that require frequent manual adjustment by manually adjusted pass assembly 24. The design shown allows for fine adjustment of final passes on the rollformer 4 so that leg angle can be manipulated. In this case, a secondary linear adjustment device 27 (e.g., manually operated worm drive linear actuator) is used to push or pull secondary slide block 28 (adjustment block slides to allow independent manual adjustment) in secondary slide gibbs 29. This changes the position of the secondary pivot point/location 30, allowing a secondary positive or negative linear motion to be added to the secondary lever arms 25. At 31, the manually adjusted pass assembly 24 is actuated by servo with other rollstands. The linkage shown in FIGS. 7B and 7C allow for mixer to be integrated with autogauge adjustment assembly, while still allowing for independent manual adjustment. FIGS. 8A and 8B show the overload assembly 19 of the manually adjusted pass assembly 24.

Figure 9:
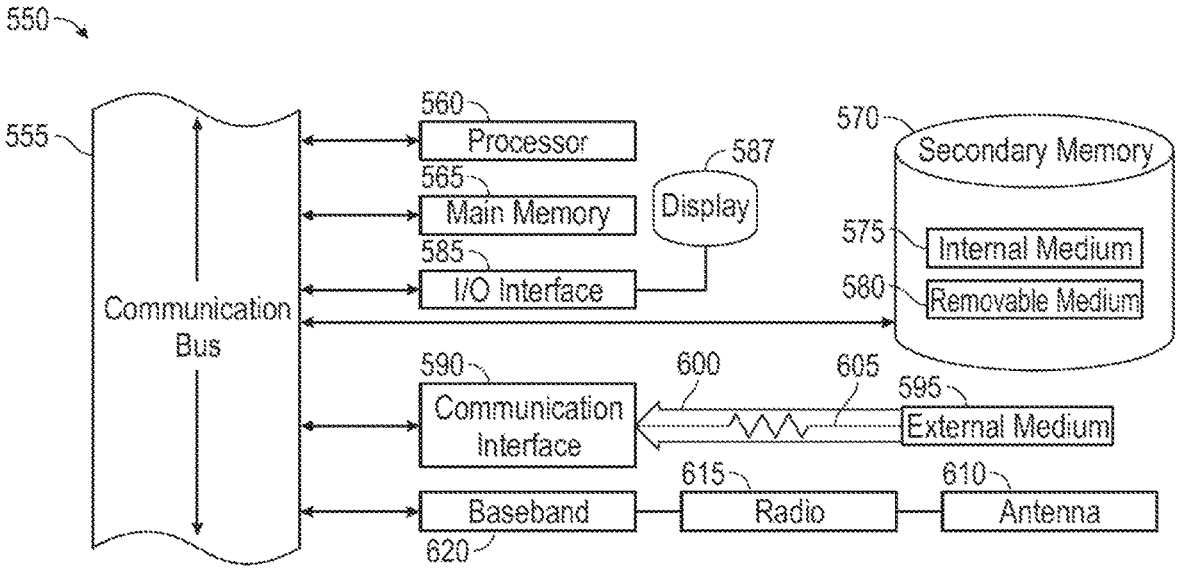
FIG. 9 is a block diagram illustrating an example wired or wireless processor enabled device that may be used in connection with various embodiments described herein.

FIG. 9 is a block diagram illustrating an example wired or wireless system 550 that may be used in connection with various embodiments described herein. For example, the system 550 may be used as or in conjunction with the computer-controlled system and computer control shown and/or described herein with respect to the auto gauge system and method for a roll forming machine. The system 550 can be a conventional personal computer, computer server, personal digital assistant, smart phone, tablet computer, or any other processor enabled device that is capable of wired or wireless data communication. Other computer systems and/or architectures may be also used, as will be clear to those skilled in the art.

The system 550 preferably includes one or more processors, such as processor 560. Additional processors may be provided, such as an auxiliary processor to manage input/output, an auxiliary processor to perform floating point mathematical operations, a special-purpose microprocessor having an architecture suitable for fast execution of signal processing algorithms (e.g., digital signal processor), a slave processor subordinate to the main processing system (e.g., back-end processor), an additional microprocessor or controller for dual or multiple processor systems, or a coprocessor. Such auxiliary processors may be discrete processors or may be integrated with the processor 560.

The processor 560 is preferably connected to a communication bus 555. The communication bus 555 may include a data channel for facilitating information transfer between storage and other peripheral components of the system 550. The communication bus 555 further may provide a set of signals used for communication with the processor 560, including a data bus, address bus, and control bus (not shown). The communication bus 555 may comprise any standard or non-standard bus architecture such as, for example, bus architectures compliant with industry standard architecture ("ISA"), extended industry standard architecture ("EISA"), Micro Channel Architecture ("MCA"), peripheral component interconnect ("PCI") local bus, or standards promulgated by the Institute of Electrical and Electronics Engineers ("IEEE") including IEEE 488 general-purpose interface bus ("GPIB"), IEEE 696/S-100, and the like.

System 550 preferably includes a main memory 565 and may also include a secondary memory 570. The main memory 565 provides storage of instructions and data for programs executing on the processor 560. The main memory 565 is typically semiconductor-based memory such as dynamic random access memory ("DRAM") and/or static random access memory ("SRAM"). Other semiconductor-based memory types include, for example, synchronous dynamic random access memory ("SDRAM"), Rambus dynamic random access memory ("RDRAM"), ferroelectric random access memory ("FRAM"), and the like, including read only memory ("ROM").

The secondary memory 570 may optionally include an internal memory 575 and/or a removable medium 580, for example a floppy disk drive, a magnetic tape drive, a compact disc ("CD") drive, a digital versatile disc ("DVD") drive, etc. The removable medium 580 is read from and/or written to in a well-known manner. Removable storage medium 580 may be, for example, a floppy disk, magnetic tape, CD, DVD, SD card, etc.

The removable storage medium 580 is a non-transitory computer readable medium having stored thereon computer executable code (i.e., software) and/or data. The computer software or data stored on the removable storage medium 580 is read into the system 550 for execution by the processor 560.

In alternative embodiments, secondary memory 570 may include other similar means for allowing computer programs or other data or instructions to be loaded into the system 550. Such means may include, for example, an external storage medium 595 and an interface 570. Examples of external storage medium 595 may include an external hard disk drive or an external optical drive, or and external magneto-optical drive.

Other examples of secondary memory 570 may include semiconductor-based memory such as programmable read-only memory ("PROM"), erasable programmable read-only memory ("EPROM"), electrically erasable read-only memory ("EEPROM"), or flash memory (block oriented memory similar to EEPROM). Also included are any other removable storage media 580 and communication interface 590, which allow software and data to be transferred from an external medium 595 to the system 550.

System 550 may also include an input/output ("I/O") interface 585. The I/O interface 585 facilitates input from and output to external devices. For example, the I/O interface 585 may receive input from a keyboard or mouse and may provide output to a display 587. The I/O interface 585 is capable of facilitating input from and output to various alternative types of human interface and machine interface devices alike.

System 550 may also include a communication interface 590. The communication interface 590 allows software and data to be transferred between system 550 and external devices (e.g. printers), networks, or information sources. For example, computer software or executable code may be transferred to system 550 from a network server via communication interface 590. Examples of communication interface 590 include a modem, a network interface card ("NIC"), a wireless data card, a communications port, a PCMCIA slot and card, an infrared interface, and an IEEE 1394 fire-wire, just to name a few.

Communication interface 590 preferably implements industry promulgated protocol standards, such as Ethernet IEEE 802 standards, Fiber Channel, digital subscriber line ("DSL"), asynchronous digital subscriber line ("ADSL"), frame relay, asynchronous transfer mode ("ATM"), integrated digital services network ("ISDN"), personal communications services ("PCS"), transmission control protocol/Internet protocol ("TCP/IP"), serial line Internet protocol/point to point protocol ("SLIP/PPP"), and so on, but may also implement customized or non-standard interface protocols as well.

Software and data transferred via communication interface 590 are generally in the form of electrical communication signals 605. These signals 605 are preferably provided to communication interface 590 via a communication channel 600. In one embodiment, the communication channel 600 may be a wired or wireless network, or any variety of other communication links. Communication channel 600 carries signals 605 and can be implemented using a variety of wired or wireless communication means including wire or cable, fiber optics, conventional phone line, cellular phone link, wireless data communication link, radio frequency ("RF") link, or infrared link, just to name a few.

Computer executable code (i.e., computer programs or software) is stored in the main memory 565 and/or the secondary memory 570. Computer programs can also be received via communication interface 590 and stored in the main memory 565 and/or the secondary memory 570. Such computer programs, when executed, enable the system 550 to perform the various functions of the present invention as previously described.

In this description, the term "computer readable medium" is used to refer to any non-transitory computer readable storage media used to provide computer executable code (e.g., software and computer programs) to the system 550. Examples of these media include main memory 565, secondary memory 570 (including internal memory 575, removable medium 580, and external storage medium 595), and any peripheral device communicatively coupled with communication interface 590 (including a network information server or other network device). These non-transitory computer readable mediums are means for providing executable code, programming instructions, and software to the system 550.

In an embodiment that is implemented using software, the software may be stored on a computer readable medium and loaded into the system 550 by way of removable medium 580, I/O interface 585, or communication interface 590. In such an embodiment, the software is loaded into the system 550 in the form of electrical communication signals 605. The software, when executed by the processor 560, preferably causes the processor 560 to perform the inventive features and functions previously described herein.

The system 550 also includes optional wireless communication components that facilitate wireless communication over a voice and over a data network. The wireless communication components comprise an antenna system 610, a radio system 615 and a baseband system 620. In the system 550, radio frequency ("RF") signals are transmitted and received over the air by the antenna system 610 under the management of the radio system 615.

In one embodiment, the antenna system 610 may comprise one or more antennae and one or more multiplexors (not shown) that perform a switching function to provide the antenna system 610 with transmit and receive signal paths. In the receive path, received RF signals can be coupled from a multiplexor to a low noise amplifier (not shown) that amplifies the received RF signal and sends the amplified signal to the radio system 615.

In alternative embodiments, the radio system 615 may comprise one or more radios that are configured to communicate over various frequencies. In one embodiment, the radio system 615 may combine a demodulator (not shown) and modulator (not shown) in one integrated circuit ("IC"). The demodulator and modulator can also be separate components. In the incoming path, the demodulator strips away the RF carrier signal leaving a baseband receive audio signal, which is sent from the radio system 615 to the baseband system 620.

If the received signal contains audio information, then baseband system 620 decodes the signal and converts it to an analog signal. Then the signal is amplified and sent to a speaker. The baseband system 620 also receives analog audio signals from a microphone. These analog audio signals are converted to digital signals and encoded by the baseband system 620. The baseband system 620 also codes the digital signals for transmission and generates a baseband transmit audio signal that is routed to the modulator portion of the radio system 615. The modulator mixes the baseband transmit audio signal with an RF carrier signal generating an RF transmit signal that is routed to the antenna system and may pass through a power amplifier (not shown). The power amplifier amplifies the RF transmit signal and routes it to the antenna system 610 where the signal is switched to the antenna port for transmission.

The baseband system 620 is also communicatively coupled with the processor 560. The central processing unit 560 has access to data storage areas 565 and 570. The central processing unit 560 is preferably configured to execute instructions (i.e., computer programs or software) that can be stored in the memory 565 or the secondary memory 570. Computer programs can also be received from the baseband processor 610 and stored in the data storage area 565 or in secondary memory 570, or executed upon receipt. Such computer programs, when executed, enable the system 550 to perform the various functions of the present invention as previously described. For example, data storage areas 565 may include various software modules (not shown) that are executable by processor 560.

Various embodiments may also be implemented primarily in hardware using, for example, components such as application specific integrated circuits ("ASICs"), or field programmable gate arrays ("FPGAs"). Implementation of a hardware state machine capable of performing the functions described herein will also be apparent to those skilled in the relevant art. Various embodiments may also be implemented using a combination of both hardware and software.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

Moreover, the various illustrative logical blocks, modules, and methods described in connection with the embodiments disclosed herein can be implemented or performed with a general purpose processor, a digital signal processor ("DSP"), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

Additionally, the steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus, the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. An auto gauge system that automatically adjusts passes for different gauges of metal material, comprising:

a servo motor that provides rotational motion;

at least one of a gearbox and linear actuator driven by the servo motor to transfer the rotational motion of the servo motor to linear motion;

a roll pass assembly including a group of roll former passes, each roll former pass including a cam arm, an eccentric cam with an eccentric feature, a push rod, a top set of roll tooling, a bottom set of roll tooling;

a bar operably coupled to the at least one of a gearbox and linear actuator and the cam arms of the group of roll former passes, the bar driven by the at least one of a gearbox and linear actuator to impart motion to the cam arms, which in turn imparts rotational motion to each eccentric cam, causing the eccentric cam to rotate and the eccentric feature to apply pressure to the push rod, raising or lowering the top set of roll tooling via the push rod, adjusting a gap between the top and bottom sets of roll tooling larger or smaller, automatically adjusting passes for different gauges of metal material.

2. The auto gauge system of claim 1, further including a matching roll pass assembly adjacent to the roll pass assembly and a cam connection shaft operably coupling respective eccentric cams of the roll pass assembly and the matching roll pass assembly to cause a same automatic adjustment of passes in the matching roll pass assembly and the roll pass assembly.

3. The auto gauge system of claim 1, further including an overload assembly between the push rod and the top set of roll tooling, the overload assembly accommodating an overload of pressure forces on the top set of roll tooling and the bottom set of roll tooling by compressing the overload assembly.

4. The auto gauge system of claim 3, wherein the overload assembly includes an overload spring between the push rod and the top set of roll tooling that compresses to accommodate the overload of pressure forces on the top set of roll tooling and the bottom set of roll tooling.

5. The auto gauge system of claim 1, further including a manually adjusted pass assembly coupled to the eccentric cam to provide fine adjustment of the gap between the top and bottom sets of roll tooling previously automatically adjusted to shape control finished metal part.

6. The auto gauge system of claim 5, wherein the manually adjusted pass assembly includes a linear adjustment device, a slide gibbs, and a slide block that may be pushed or pulled in the slide gibbs by the secondary adjustment device to provide fine adjustment of the gap between the top and bottom sets of roll tooling previously automatically adjusted to shape control finished metal part.

7. The auto gauge system of claim 6, wherein the manually adjusted pass assembly includes a pivot point, lever arms, and the pushing or pulling of the slide block in the slide gibbs by the linear adjustment device changes a position of the pivot point, allowing a positive or negative linear motion to be added to the lever arms, which provides fine adjustment of the gap between the top and bottom sets of roll tooling previously automatically adjusted to shape control finished metal part.

8. An auto gauge system that automatically adjusts passes for different gauges of metal material, comprising:

a servo motor that provides rotational motion;

at least one of a gearbox and linear actuator driven by the servo motor to transfer the rotational motor of the servo motor to linear motion;

a roll pass assembly including a group of roll former passes, each roll former pass including a cam arm, an eccentric cam with an eccentric feature, a push rod, a top set of roll tooling, a bottom set of roll tooling;

a manual adjustment roll pass assembly mechanism including a linear adjustment device, a slide gibbs, and a slide block that may be pushed or pulled in the slide gibbs by the linear adjustment device to provide fine adjustment of the gap between the top and bottom sets of roll tooling previously automatically adjusted to shape control finished metal part;

a bar operably coupled to the gearbox and the cam arms of the group of roll former passes, the bar driven by the at least one of a gearbox and linear actuator to impart motion to the cam arms, which in turn imparts rotational motion to each eccentric cam, causing the eccentric cam to rotate and the eccentric cam's eccentric feature to apply pressure to the push rod, raising or lowering the top set of roll tooling via the push rod, adjusting a gap between the top and bottom sets of roll tooling larger or smaller, automatically adjusting passes for different gauges of metal material, and the manual adjustment roll pass assembly mechanism is configured to impart motion to the cam arm, causing the eccentric cam to rotate and the eccentric feature to apply pressure to the push rod, raising or lowering the top set of roll tooling via the push rod, mixing fine adjustment of the gap between the top and bottom sets of roll tooling with the previous automatic adjustment of the gap between the top and bottom sets of roll tooling.

9. The auto gauge system of claim 8, wherein the manually adjusted pass assembly includes a pivot point, lever arms, and the pushing or pulling of the slide block in the slide gibbs by the linear adjustment device changes a position of the pivot point, allowing a positive or negative linear motion to be added to the lever arms, which provides fine adjustment of the gap between the top and bottom sets of roll tooling.

* * * * *